US006688664B2

(12) United States Patent
Sioutis

(10) Patent No.: US 6,688,664 B2
(45) Date of Patent: Feb. 10, 2004

(54) MULTI-FUNCTIONAL VEHICLE EQUIPPED WITH FIRE FIGHTING EQUIPMENT AND EQUIPMENT FOR FREEING, RESCUING AND TRANSPORTING INJURED ENTRAPPED PERSONS

(76) Inventor: George Sioutis, 91 Voriou Ipirou, GR-165 62 Ano Glifada (GR), Ano Glifada (GR)

( * ) Notice: Subject to any disclaimer, the term of this patent is extended or adjusted under 35 U.S.C. 154(b) by 0 days.

(21) Appl. No.: 10/275,240

(22) PCT Filed: May 3, 2001

(86) PCT No.: PCT/GR01/00022

§ 371 (c)(1),
(2), (4) Date: Oct. 31, 2002

(87) PCT Pub. No.: WO01/83036

PCT Pub. Date: Nov. 8, 2001

(65) Prior Publication Data

US 2003/0102685 A1 Jun. 5, 2003

(51) Int. Cl.[7] ..... A61G 3/00; A62C 27/00
(52) U.S. Cl. ..... 296/24.1; 296/20; 169/24
(58) Field of Search ..... 296/19, 20, 24.1; 169/24

(56) References Cited

U.S. PATENT DOCUMENTS

| | | | | | |
|---|---|---|---|---|---|
| 4,291,769 | A | | 9/1981 | Muller | |
| 4,830,421 | A | * | 5/1989 | Hawelka et al. | 296/24.1 |
| 5,467,827 | A | | 11/1995 | McLoughlin | |
| 5,573,300 | A | * | 11/1996 | Simmons | 296/197 |
| 5,785,372 | A | | 7/1998 | Glatzmeier et al. | |
| 6,029,750 | A | * | 2/2000 | Carrier | 169/52 |
| 2002/0000731 | A1 | * | 1/2002 | Wieczorek et al. | 296/24.1 |

FOREIGN PATENT DOCUMENTS

| | | | | |
|---|---|---|---|---|
| CH | 481 6541 | | 11/1969 | |
| DE | 86 04 097 | | 5/1986 | |
| DE | 38 02 187 | | 5/1989 | |
| EP | 0 308 136 | | 3/1989 | |
| EP | 0 417 615 | | 3/1991 | |
| ES | 2 114 776 | | 6/1998 | |
| FR | 1471914 | * | 3/1967 | 296/24.1 |
| GB | 2 159 777 | | 12/1985 | |
| GB | 2 244 959 | | 12/1991 | |

* cited by examiner

*Primary Examiner*—Dennis H. Pedder

(57) ABSTRACT

The invention is referring to the field of the art of fire-fighting vehicles, rescue vehicles and ambulances, proposing specifically the construction of a multi-functional vehicle which, with the properly disposed equipment and ergonomy, can combine and accomplish all three missions, that is, fire fighting, freeing and rescuing injured entrapped persons and subsequently transportation of these injured persons after, mainly, a car accident. According to the preferred embodiment this single multi-functional vehicle by itself replaces at least three vehicles—that is a fire fighting, a rescue vehicle and two ambulances, having as crew only three persons.

6 Claims, 19 Drawing Sheets

F.17

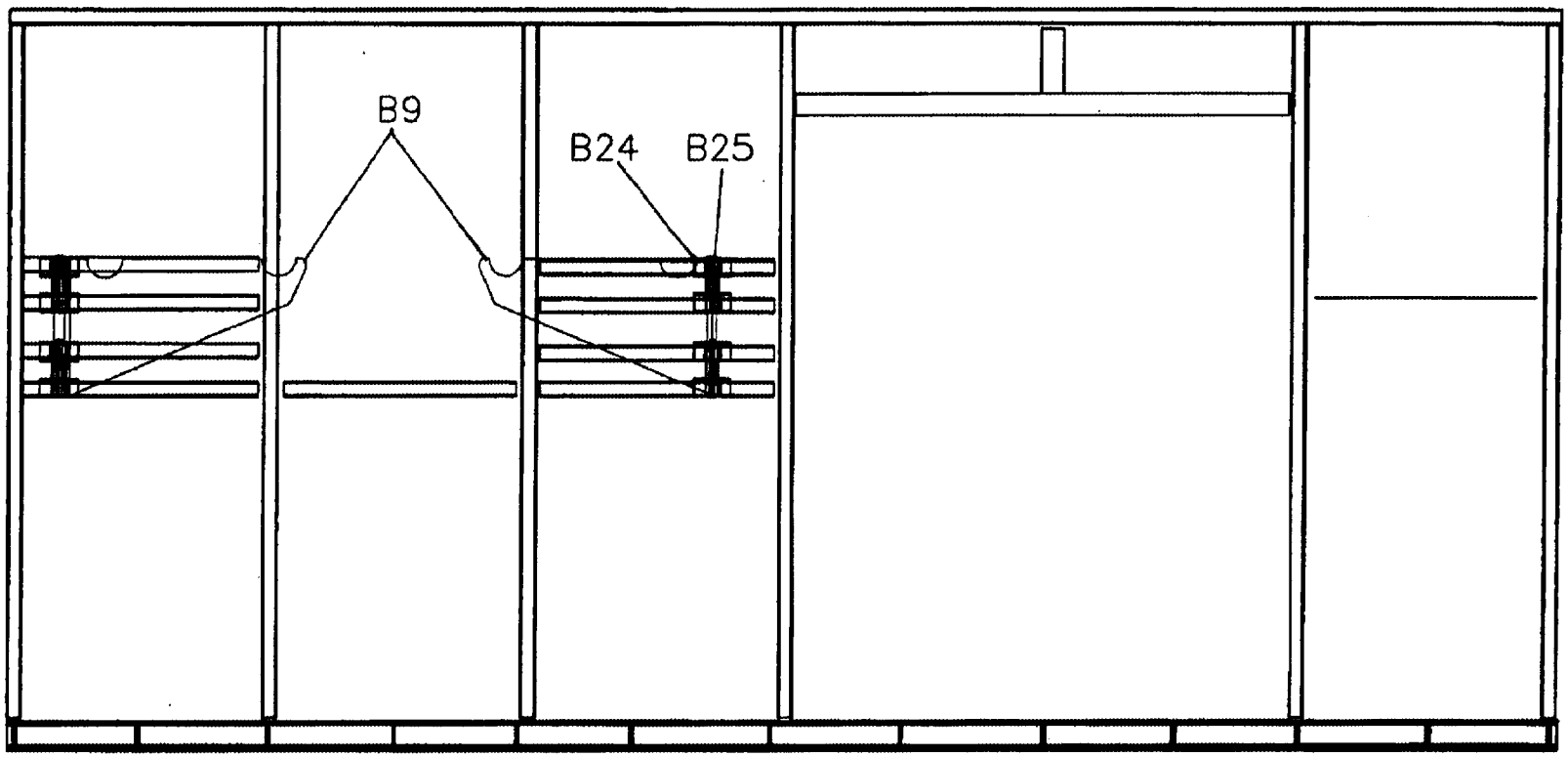
F.19

MULTI-FUNCTIONAL VEHICLE EQUIPPED WITH FIRE FIGHTING EQUIPMENT AND EQUIPMENT FOR FREEING, RESCUING AND TRANSPORTING INJURED ENTRAPPED PERSONS

THE FIELD OF THE ART

The invention is referring to the field of the art of the fire-fighting vehicles, the rescue vehicles and the ambulances, proposing specifically the construction of a vehicle which, with the properly disposed equipment and ergonomy, can combine and accomplish all three missions, that is fire fighting, freeing and rescuing injured entrapped persons and subsequently transporting those persons, which have become injured mainly as a consequence of a car accident. According to a preferred embodiment, the proposed vehicle replaces at least three conventionally independent vehicles, i.e. one fire fighting, one rescue vehicle with equipment suitable for freeing entrapped persons and two ambulances, having an illustratively proposed crew of only three persons.

THE PRIOR ART

The vehicle proposed in the present invention has not been disclosed in the prior art. The vehicles which are being used today for the accomplishment of the above-mentioned operations (fire fighting, freeing-rescuing and transporting injured persons) are independent vehicles that usually are under the command of different services; the result is that, often, the accomplishment of their mission is not possible, as by way of example is the case with car accidents, which is a de facto complicated mission.

It would have been possible to significantly reduce the immense material losses and most importantly losses of human lives involved in car accidents, if there weren't objective difficulties of the organisations that undertake the mission of dealing with the accident after it has occurred, such difficulties being centered at the lack of specialised units located at crucial points of national and regional road networks, such units being equipped with sufficient and proper human resources and equipment, so as to accomplish the scope of an ambulance equipped with proper rescuing and fire fighting means.

The composition of such properly organised units, although it would contribute decisively to the reduction of casualties, is not possible until today, because of the excessively high cost, since for every such station is needed an oversupply of special vehicles and a big number of employees. The difficulties arising as a result of the current situation are daily and they consist in the loss of valuable time, which is by way of example due to the delayed arrival of an ambulance which in any case has the limited capability of transporting only two injured persons, whilst in a car accident, two persons is usually the minimum of the involved injured, or due to the delayed arrival of a vehicle with rescuing equipment, having as crew firemen of general duties and insufficient training for the rescuing of entrapped people. Furthermore, such vehicles of the prior art are usually equipped with improper equipment and thereby are incapable of handling complex situations arising from the broadly varying conditions encountered in road accidents.

There is a broad patent literature referring to vehicles adapted to be used in either one of the operations of fire-fighting, rescue or salvation and first aid or ambulance. By way of example EP 0 417 615 of Binz GmbH & Co describes an ambulance which is equipped so as to be enabled to provide enhanced medical care to transported patients, but is restricted to the mere function of an ambulance. On the other hand EP 0 308 136 of Cleveland County Council refers to emergency vehicles such as those operated by fire brigades, which can carry alternative equipment so as to cope adequately with different eventualities, but which is not however capable of transporting patients or injured.

In the same way GB 2 159 777 of Rosenbauer Konrad K G, U.S. Pat. No. 5,785,372 of Glatzmeier Alfred et al, U.S. Pat. No. 5,467,827 of Mcloughlin John, DE-38 02 187 of Rosenbauer Int. GmbH and DE-U-86 04 097 of CST MBH disclose various alternative improvements in fire fighting vehicles, without however including the possibility of these vehicles acting as rescue and/or ambulance vehicles.

Finally ES 2 114 776 or CH 481 651 disclose rescue vehicles, which are however incapable of transporting patients.

It is obvious that none of the vehicles disclosed in the hereinabove cited patent literature can be adapted to be used in effectively handling of a car accident, wherein it is often required to perform the combination of three functions, i.e. of fire-fighting, freeing entrapped persons and finally having the capacity of transporting a plurality of injured persons.

It thereby is the object of the present invention to effectively overcome the disadvantages and deficiencies of the prior art, by proposing the design and construction of a single vehicle which will be capable of covering the overall needs of an incident, since it will combine the possibilities of a fire fighting vehicle with special rescuing equipment including equipment for freeing entrapped persons and further including a sufficient number of positions for the transportation of the injured persons, for instance, having a capacity equivalent to two ambulances, thereby the proposed vehicle being capable of effectively coping with a road accident involving the occurrence of fire, entrapped persons and plurality of injured persons to provide with first aid and transport to hospital.

The invention offers, amongst others, the following: important advantages:

A. Expertise, since personnel of only three persons who are employed in accomplishment of the particular special object of the invention, will in time obtain valuable experience in the usage of the proper instruments, so as to find and use in each particular case the advisable and secure means of intervention, taking into consideration that no incident is identical with another.

B. The financial burden is substantially reduced because of the usage of only one vehicle and a diminished number of employees for every incident.

C. The vehicle can be used also for other kinds of incidents, such as air accidents, natural calamities, etc.

D. The problem of the co-ordination of a minimum number of two independent authorities which are conventionally involved in dealing with the accident, thereby resulting to elimination of the delays which may have tragic consequences. In this way the additional effect of minimization of the required administrative cost is also noticeable.

E. The invention, recapitulating the above-mentioned advantages, eliminates all the current technical-economic difficulties in advantage of the society and the economy.

BRIEF DESCRIPTION OF THE DRAWINGS

The invention will be made fully apparent to those skilled in the art through reference to the accompanying drawings, wherein is depicted in an illustrative and not confining manner a certain embodiment thereof.

FIG. 19 presents a view of a foldable base of an auxiliary stretcher of the vehicle, in closed position.

DETAILED DESCRIPTION OF THE PREFERRED EMBODIMENT

Referring now to the accompanying drawings, we will describe the invention as disclosed in the illustratively preferred embodiment depicted therein.

Figure 1:
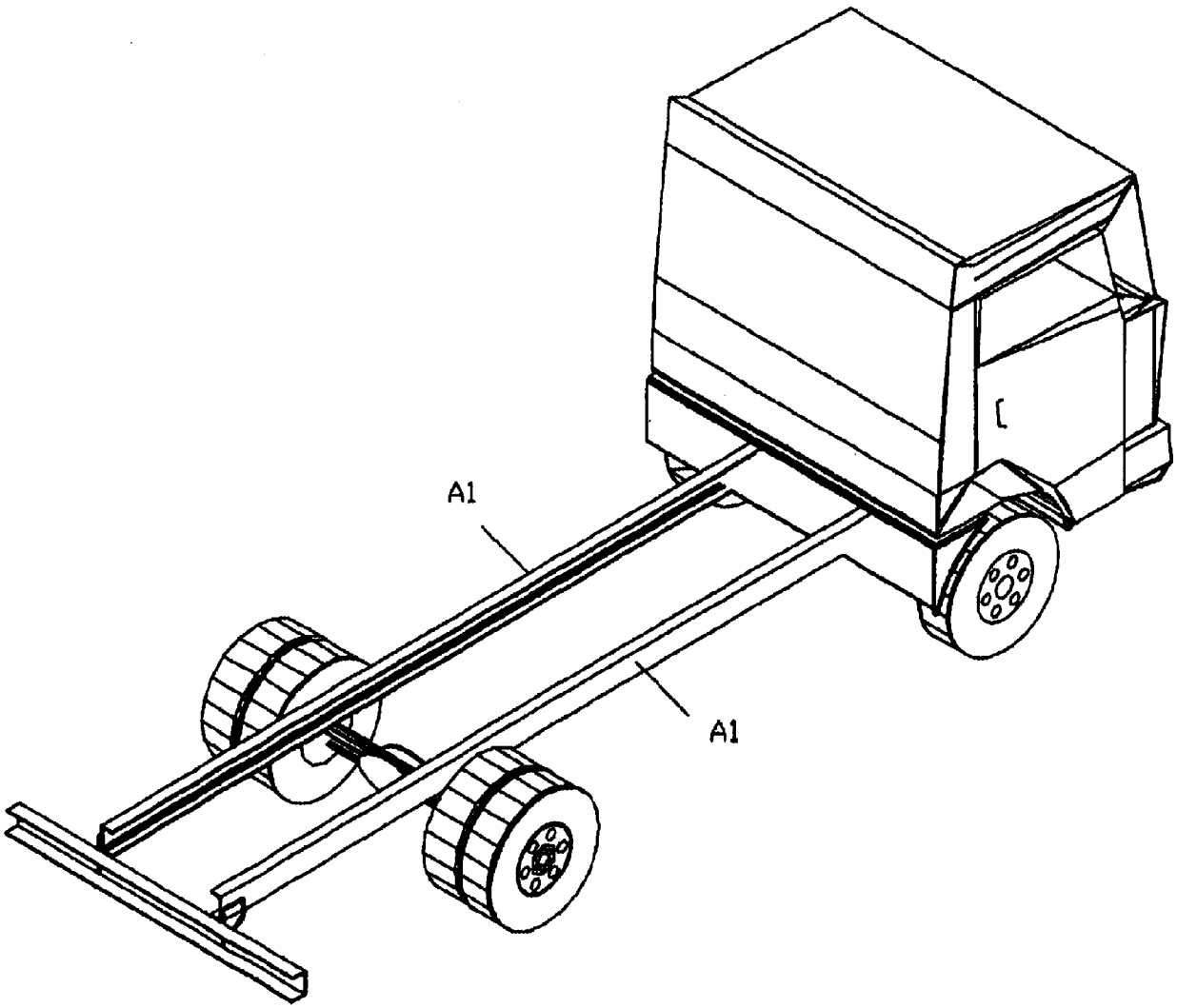
FIG. 1 presents in a perspective representation a typical, illustrative type of a motor truck, which is capable of carrying the hyper-construction for the multi functional vehicle of the invention for fire fighting, freeing, rescuing and transporting of persons injured in an accident.

As shown in FIG. 1, a common motor truck carrying a frame, is possible to be used for the mounting and the connection of a hyper-construction, in order for the above-mentioned motor truck to be transformed to the special multi functional vehicle for the fire fighting, freeing, rescuing and injured persons' transportation, which is suggested especially for the effective handling of car accidents.

Figure 7:
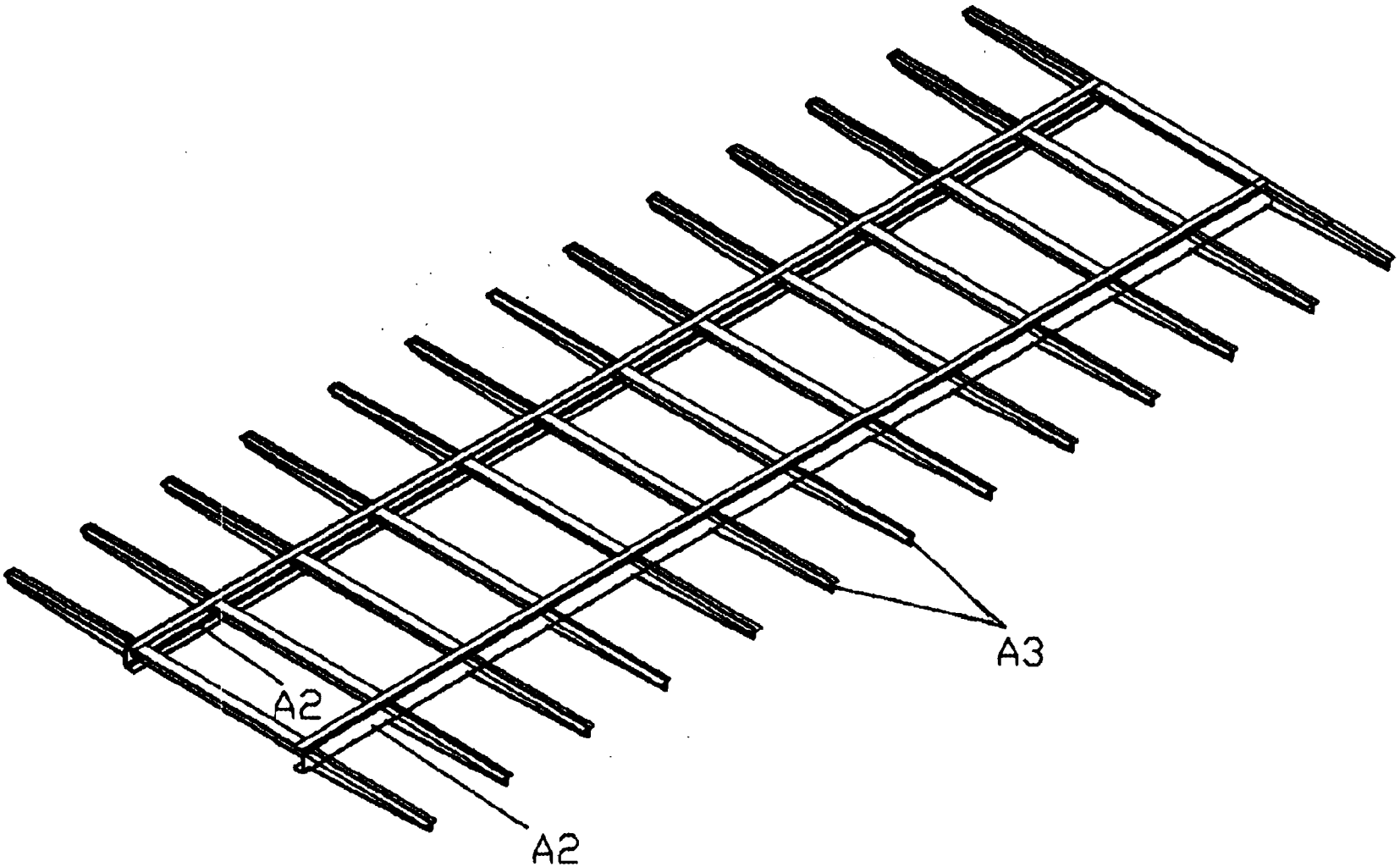
FIG. 7 presents in a perspective representation part of the base sub-frame whereupon the above mentioned hyper-construction is being seated.
Figure 8:
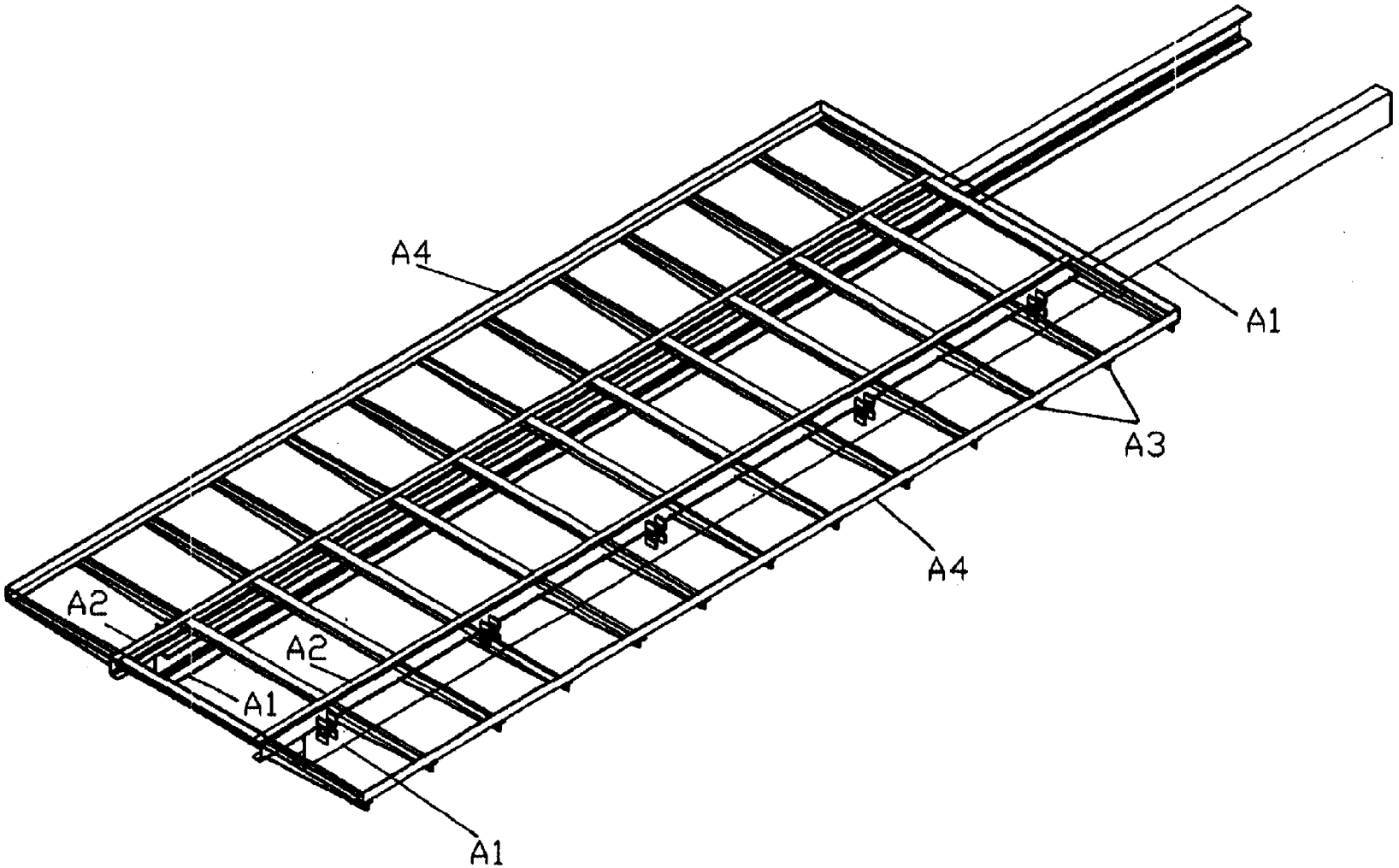
FIG. 8 presents in a perspective representation the integrated structure of the base sub-frame whereupon the hyper-construction is being seated.

For the mounting and connecting of the hyper-construction onto the longitudinally extending parallel beams of II section A1 that are composing the frame of the motor truck (FIG. 1), is used the sub-frame depicted in FIG. 7 and FIG. 8, which includes a pair of longitudinally extending parallel beams A2 of II section, and an arrangement of an illustrative plurality of parallel interconnecting transverse beams A3 which are perpendicularly disposed upon beams A2 and have a T cross-section. The circumference of the thereby formed rectangle is fastened with angular bars A4 (FIG. 8) which are extending in a parallel direction to the beams A2.

Figure 9:
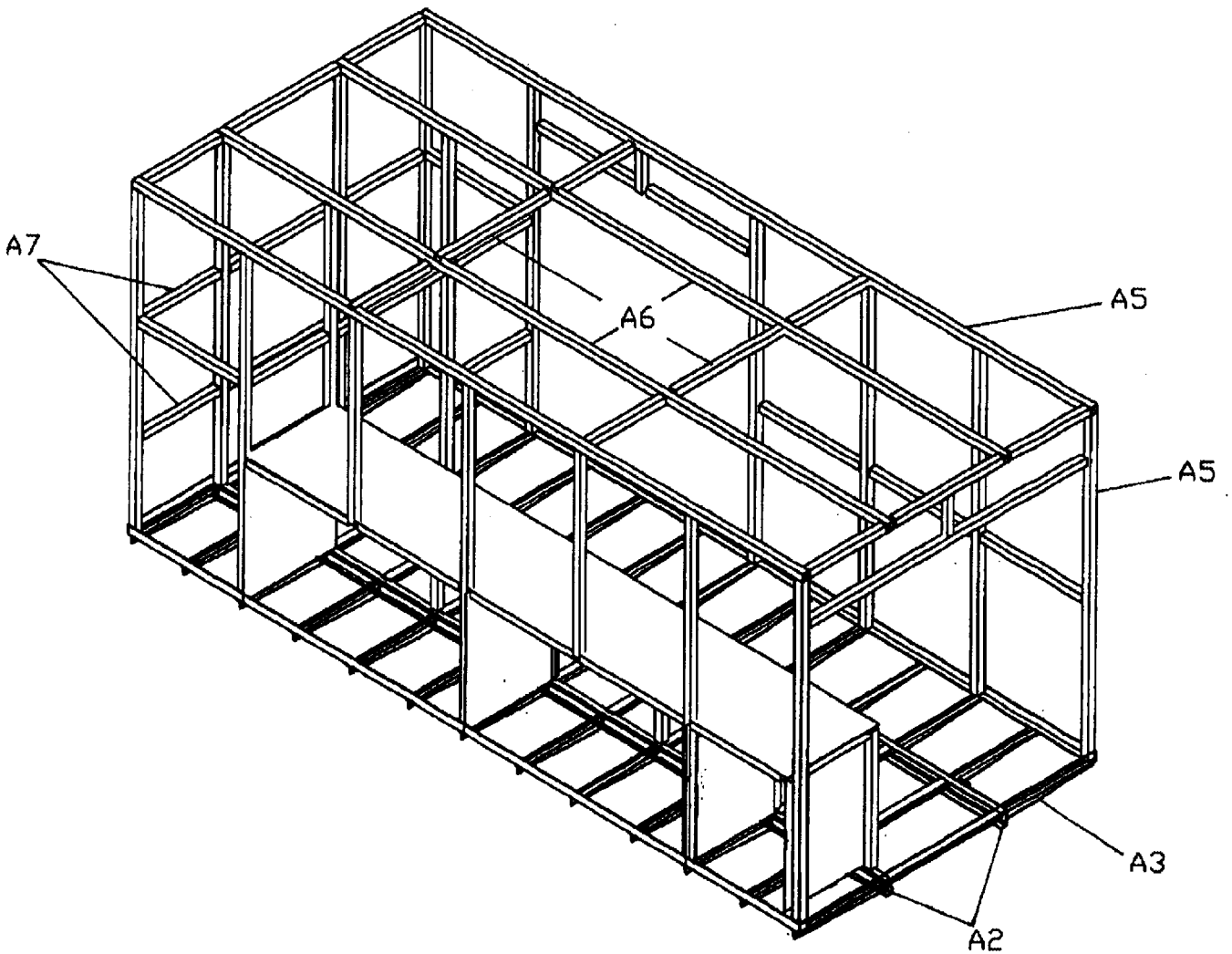
FIG. 9 presents in a perspective representation the structure of the hyper-construction that is mounted onto the motor truck.

Subsequently, onto the sub-frame that has been shaped in this way and is seated onto the frame of the motor truck, is constructed the framework of the hyper-construction cabin. As shown in FIG. 9, the above-mentioned cabin is constituted by an arrangement of, vertically and horizontally, circumferentially extending interconnecting beams A5. The frame in the ceiling of the hyper-construction is being formed using similar interconnecting beams A6. Interconnecting beams of similar configuration are used in building of the chamber of the fire extinguishers, of the interior of the equipment lockers and in building of the supporting structure of a special stretcher with which the vehicle is equipped.

The hyper-construction framework, which is assembled in the above mentioned manner with interconnected, welded concave beams of various cross sections and dimensions, and with the usage of additional reinforcing elements (angles, etc.), is coated with sheet metal covering, whilst an additional metal layer is being laid on the floor, ceiling and circumference of the thereby formed compartments, wherein proper doors of the various compartments are also being provided. The compartment for the transportation of patients—injured persons is preferably sound and heat insulated with a layer of insulating material, which is subsequently being covered with a layer of polyester or other appropriate material in the interior of the compartment, in order to permit a liquid cleansing and disinfecting, whilst the floor of the same compartment is shaped with special, hermetically bound tiles.

Figure 4:
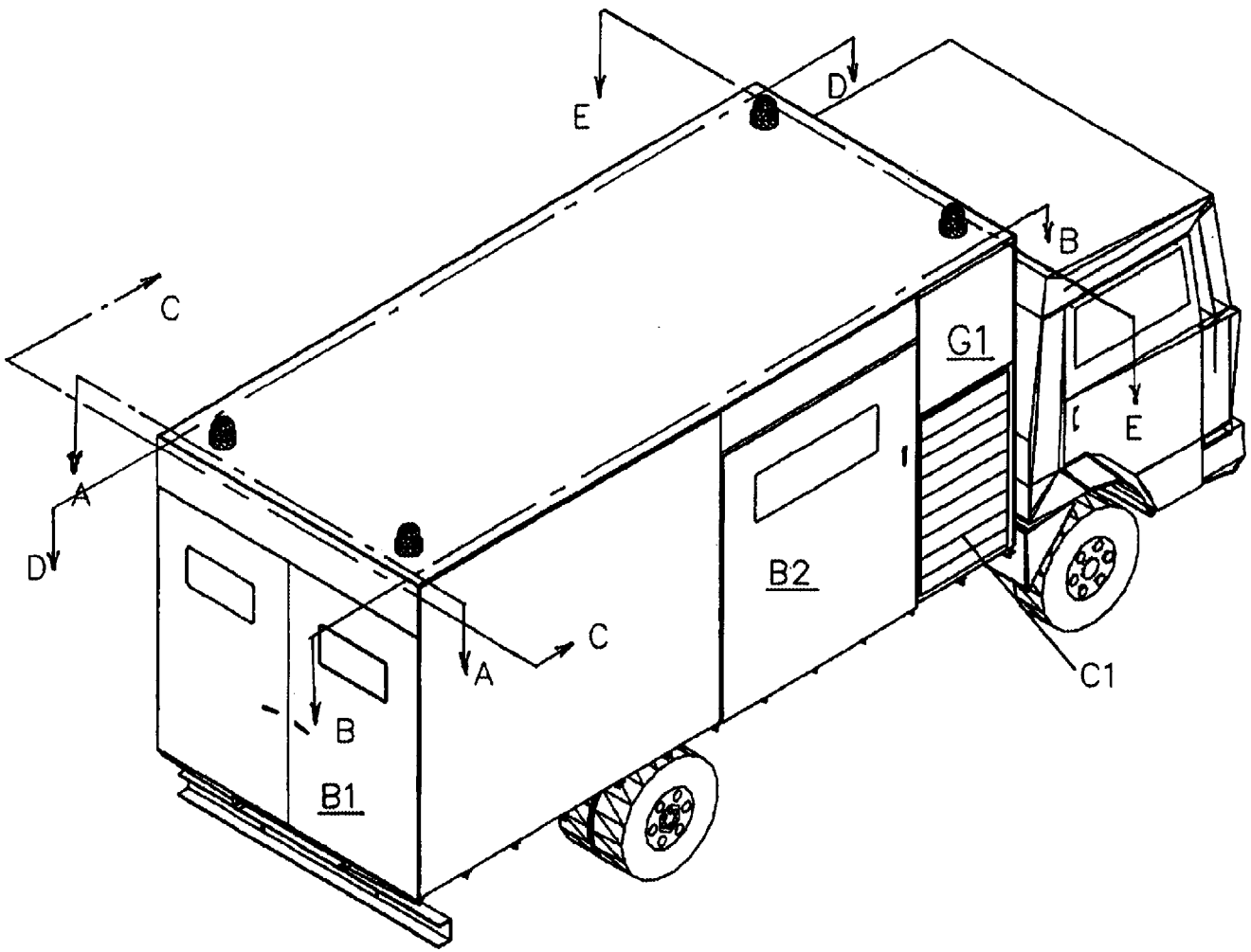
FIG. 4 presents in a perspective representation an alternative right back side view of the same vehicle and presents closed the relative doors. In this Figure are also defined the cross sectional views that are going to be presented in subsequent figures.
Figure 5:
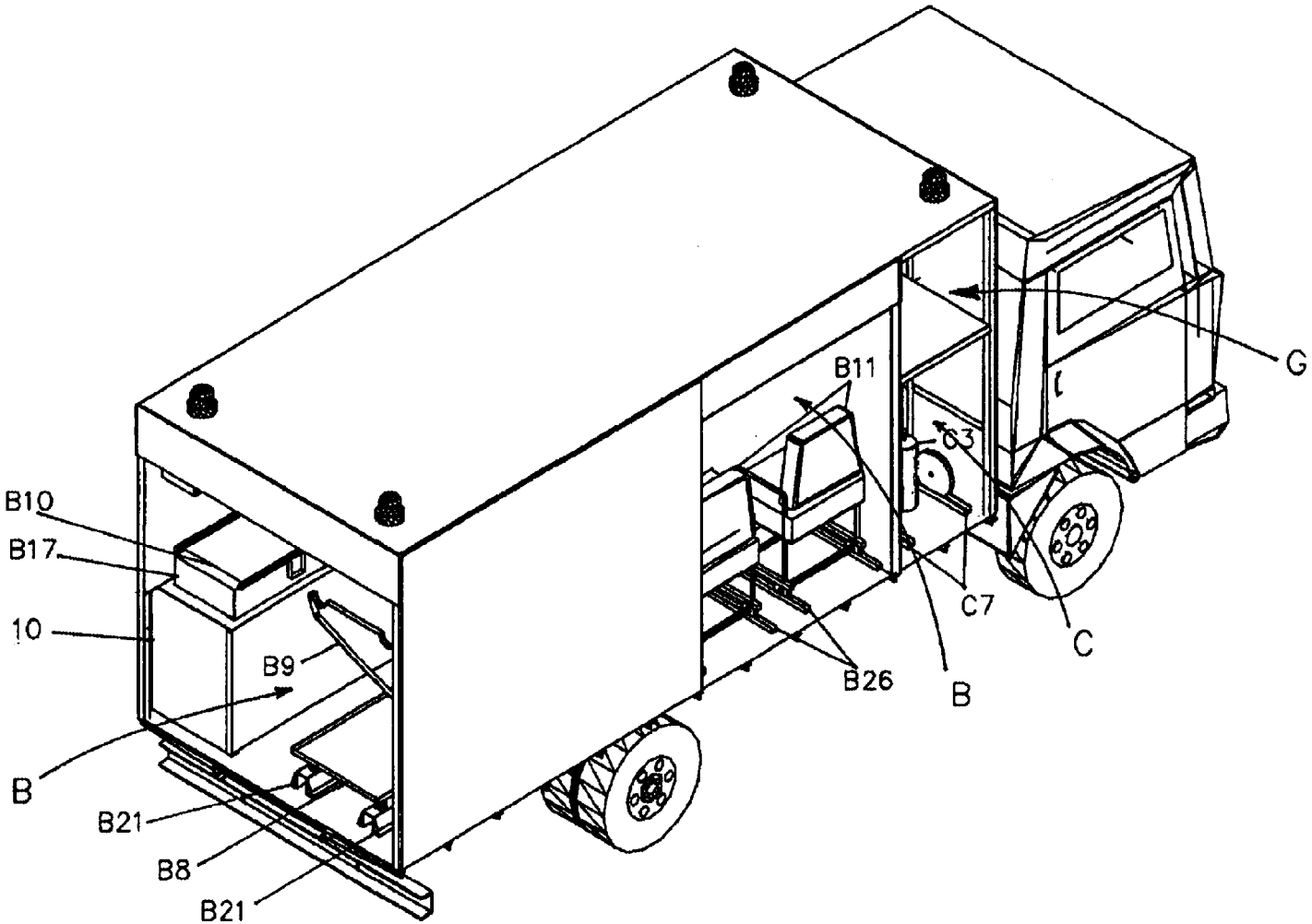
FIG. 5 presents in a perspective representation, the view of FIG. 4 with the relative doors being opened.
Figure 6:
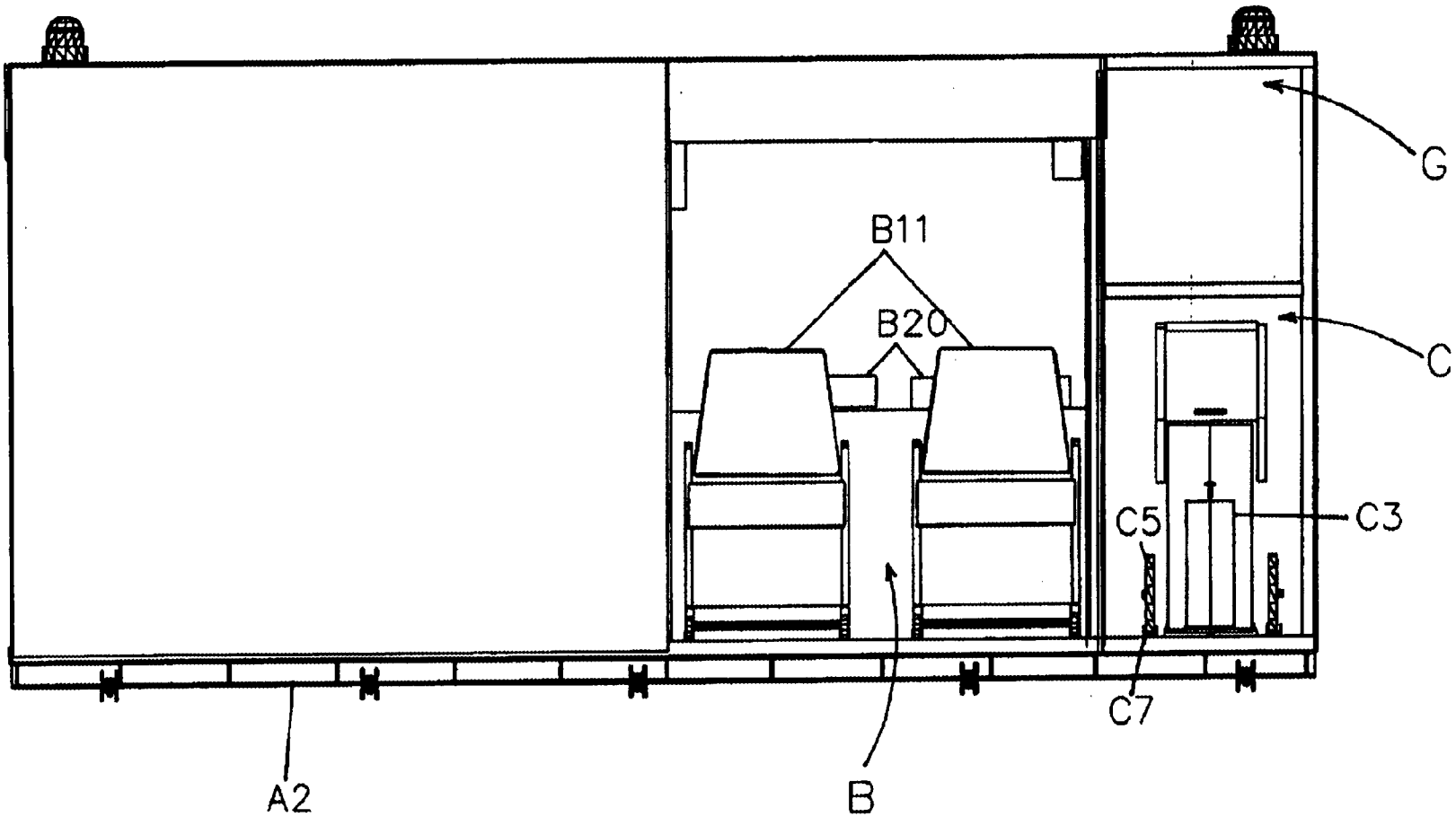
FIG. 6 presents the right side of the vehicle, wherein are shown opened the compartments of the patients' cabins, of fire fighting and material storage.

The hyper-construction, thus shaped, is seated and connected onto the frame of the motor truck through the above-described sub-frame and it is characterised by the fact that it is divided in autonomous, independent compartments, wherein each one of these compartments and the whole of the hyper-construction have an ergonomic design with the appropriate arrangement of their equipment. According to the preferred, illustrative embodiment of the invention, the above-mentioned compartments are the following:

Compartment B for injured persons and patients, with entrances B1 at the back side of the vehicle and B2 at the right side thereof (FIG. 4).

Compartment C for the fire fighting equipment with entrances C1 at the right side (FIG. 4) and C2 at the left side thereof (FIG. 2), wherein the relative doors illustratively have the configuration of a foldable screen roll.

Figure 2:
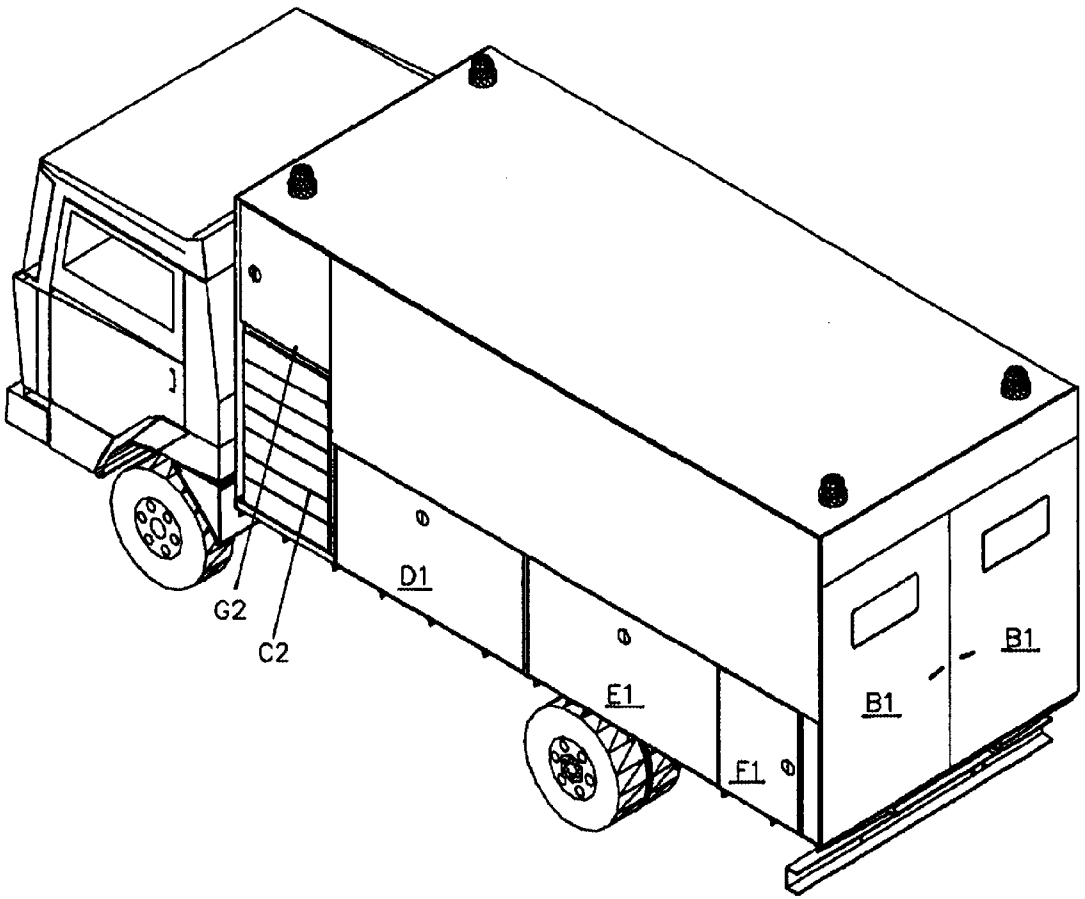
FIG. 2 presents in a perspective representation, the motor truck of FIG. 1 with the hyper-construction for the fire fighting, freeing, rescuing and transporting of the injured persons mounted thereupon, wherein the representation is focused on the left back side and presents closed the relative doors.

Compartment D, E for installation of equipment for freeing and rescuing entrapped people with doors D1, E1 at the left side of the vehicle (FIG. 2).

Compartment F for the storage of cleansing liquids and disinfectants, gloves, cloths, etc. with a door F1 at the left side of the vehicle (FIG. 2).

Compartment G for the storage of equipment used in the compartment B for injured persons and patients, such as blankets, stretchers, etc., with entrances G1 (FIG. 4) and G2 (FIG. 2) at the right and left side thereof respectively.

With the above or other similar dimensioning and ergonomic disposition, the design process of the proposed multi functional vehicle for fire fighting, freeing, rescuing entrapped persons and transportation of the injured places a special importance in the sufficiency of the equipment and the complementary—auxiliary solutions that are given through it, in order to insure that in every case the intervention of the vehicle will be successful.

In the fire fighting compartment C, the interior part of which is visible at FIGS. 3, 5, 6, 13, 14, 15, 16, is located a pair of fire extinguishers of chemical powder, appropriate for the extinguishing of fires of the type A, B, C, these extinguishers being indicated with numerals C3, C4 (FIG. 5), wheeled onto wheels C5, C6, rolling on fixedly mounted guides C7, C8, and having the possibility to be extracted through the right and left doors C1, C2 respectively. The fire extinguishers are of the fast securing type, each one disposes of an independent launching tube with a suggested length of the order of 10 m.

With these fire-extinguishers it is possible to effectively deal with any fire manifestation of at least three private motor cars, the extinguishers also being used preventively or as a matter of precaution in case of fuel leakage. Furthermore, in the fire-fighting compartment C are located, suspended and secured, crow bars of special edge shaping and an axe.

Figure 3:
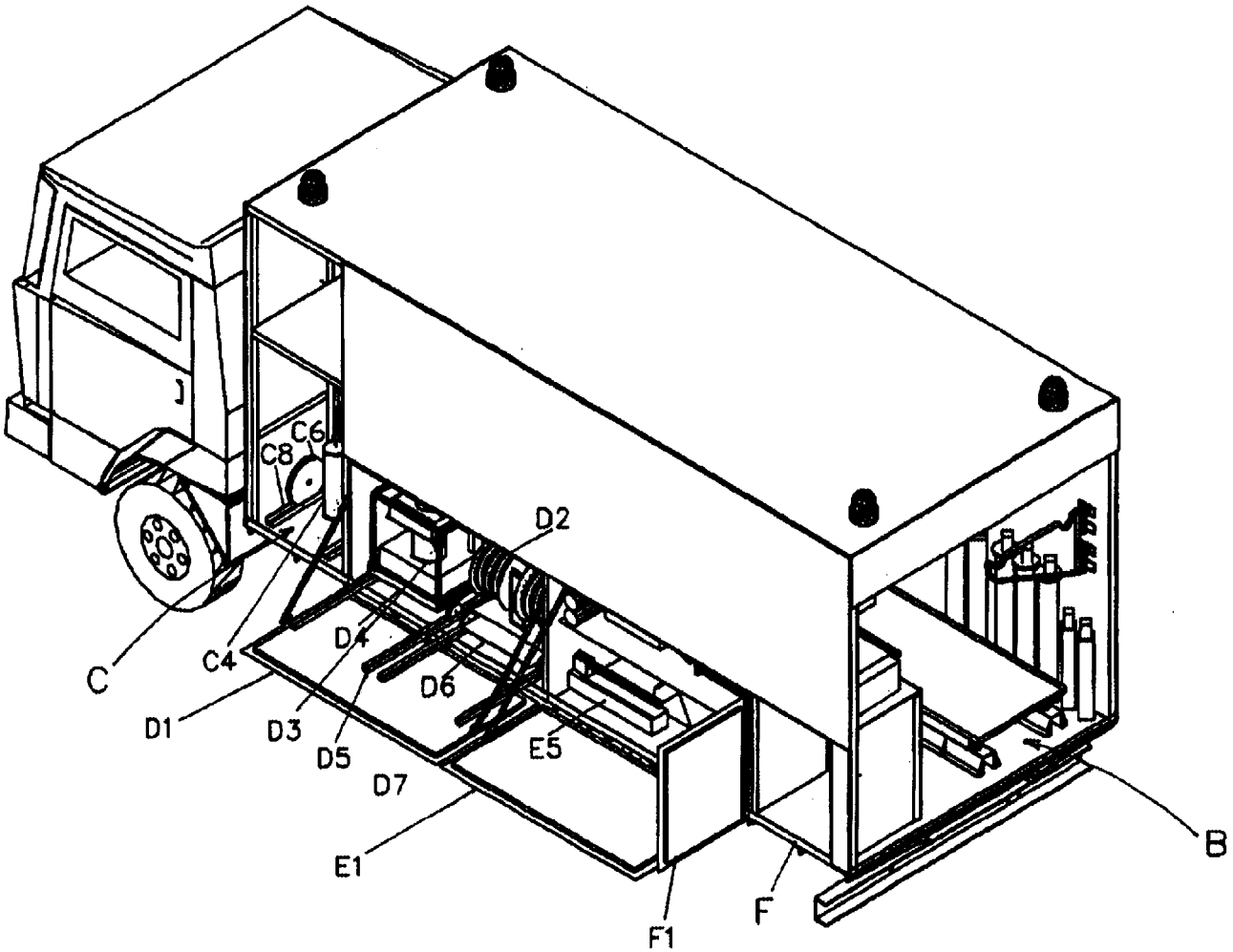
FIG. 3 presents in a perspective representation an alternative view of the vehicle of FIG. 2 which is again, focused on the left back side and presents opened the relative doors.
Figure 10:
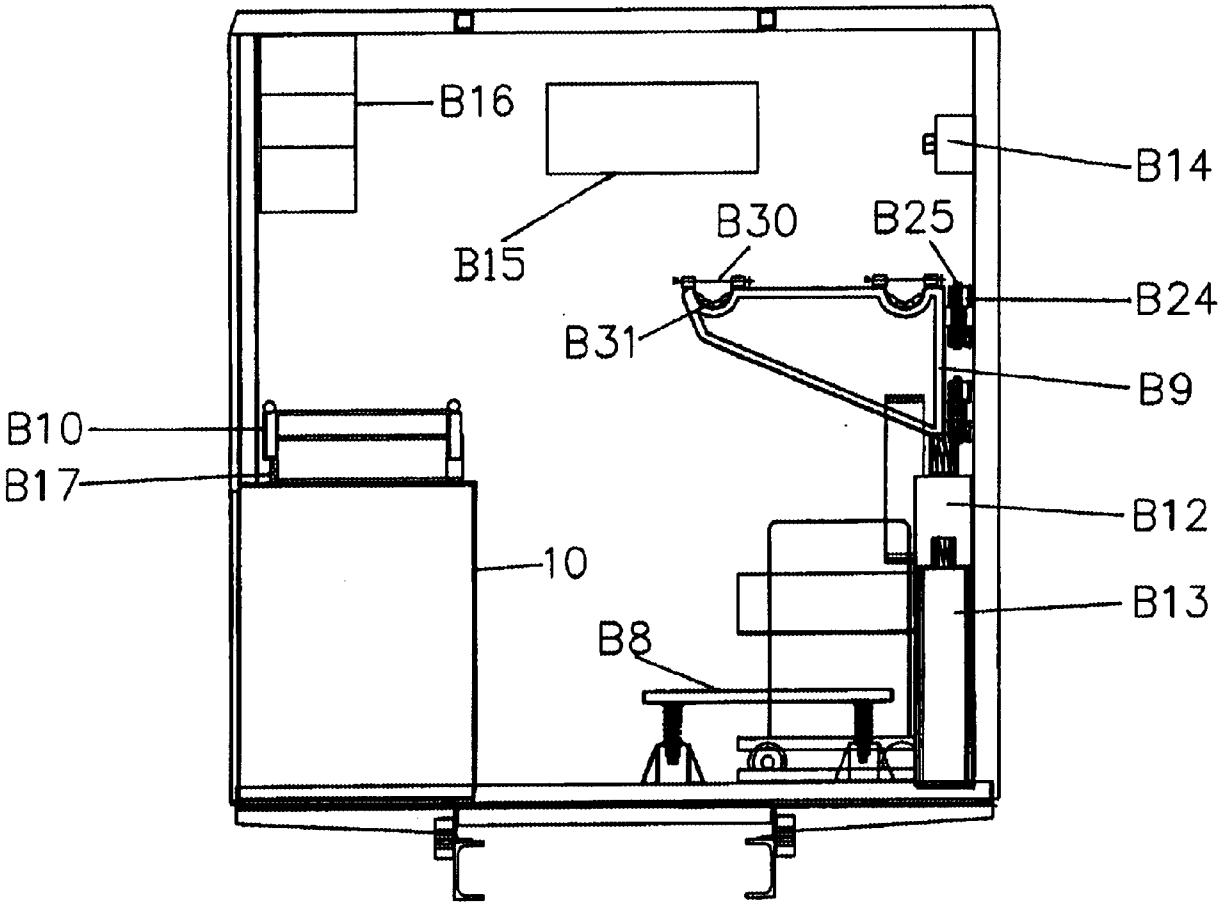
FIG. 10 presents the cross sectional view A—A (FIG. 4) on the back side of the vehicle.
Figure 11:
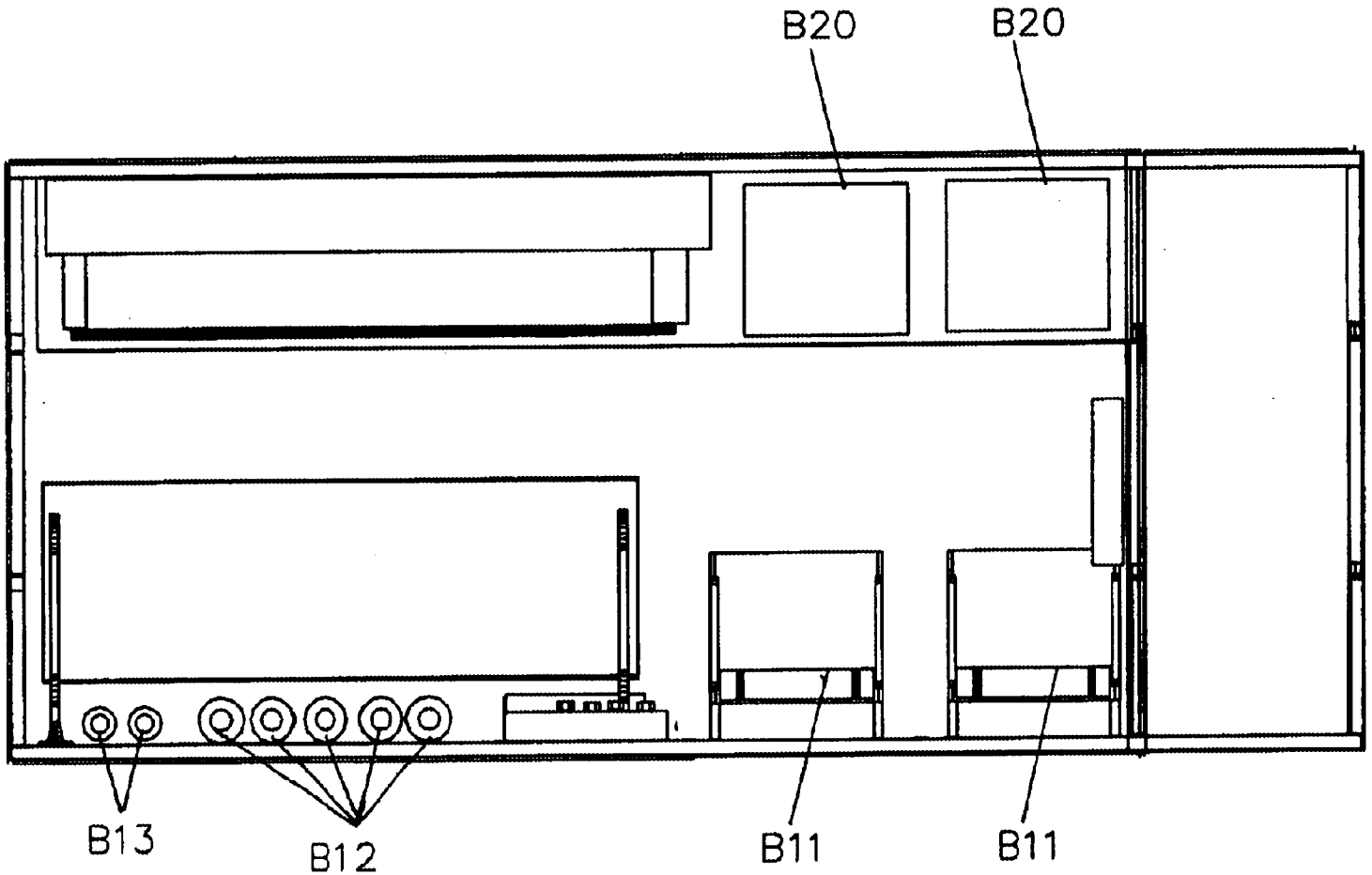
FIG. 11 presents the longitudinal cross sectional view C—C (FIG. 4) of the vehicle.
Figure 12:
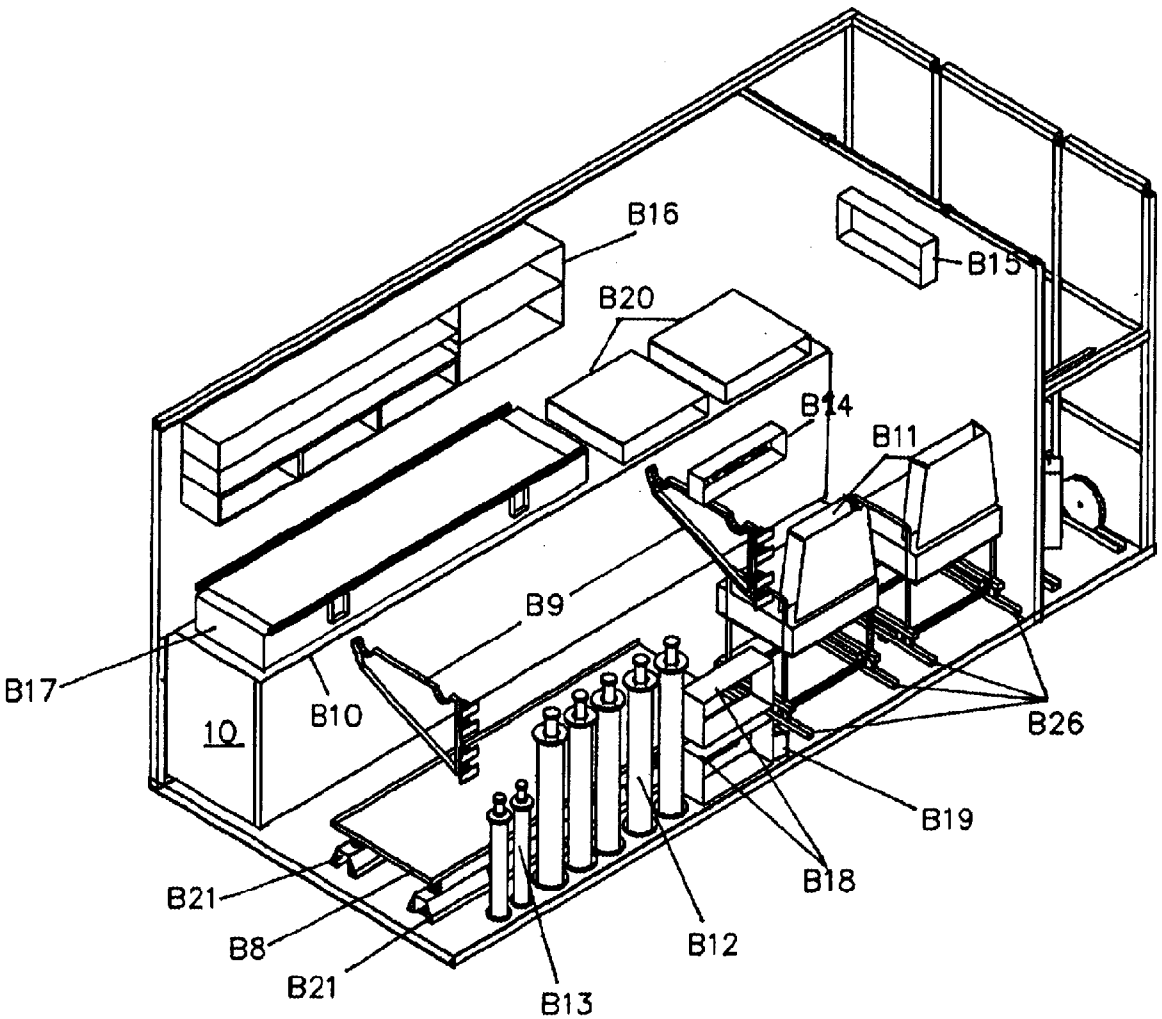
FIG. 12 presents in a perspective representation the vehicle opened along the section lines A—A, B—B and C—C.
Figure 13:
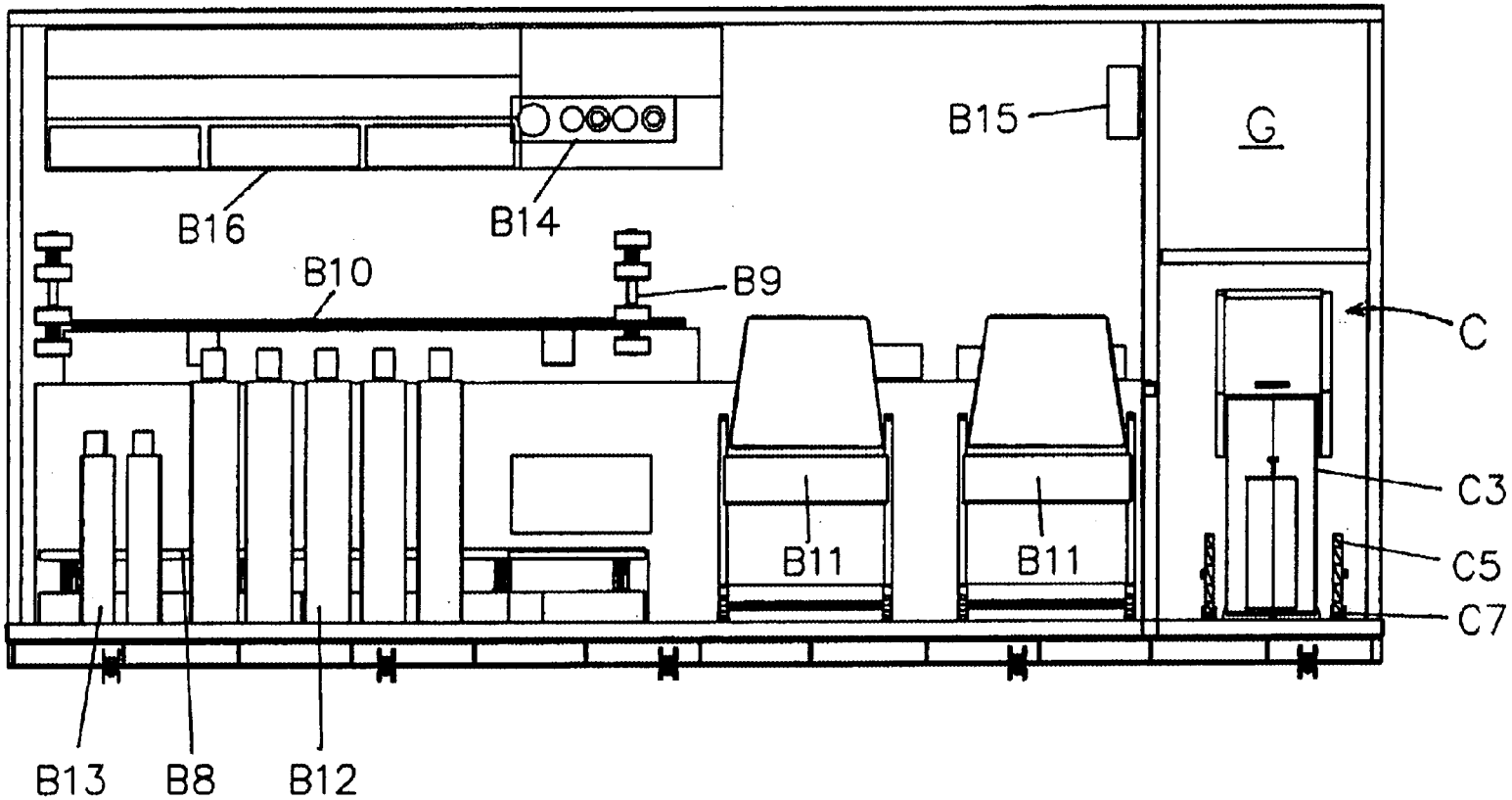
FIG. 13 presents the longitudinal cross sectional view B—B (FIG. 4) of the vehicle.
Figure 14:
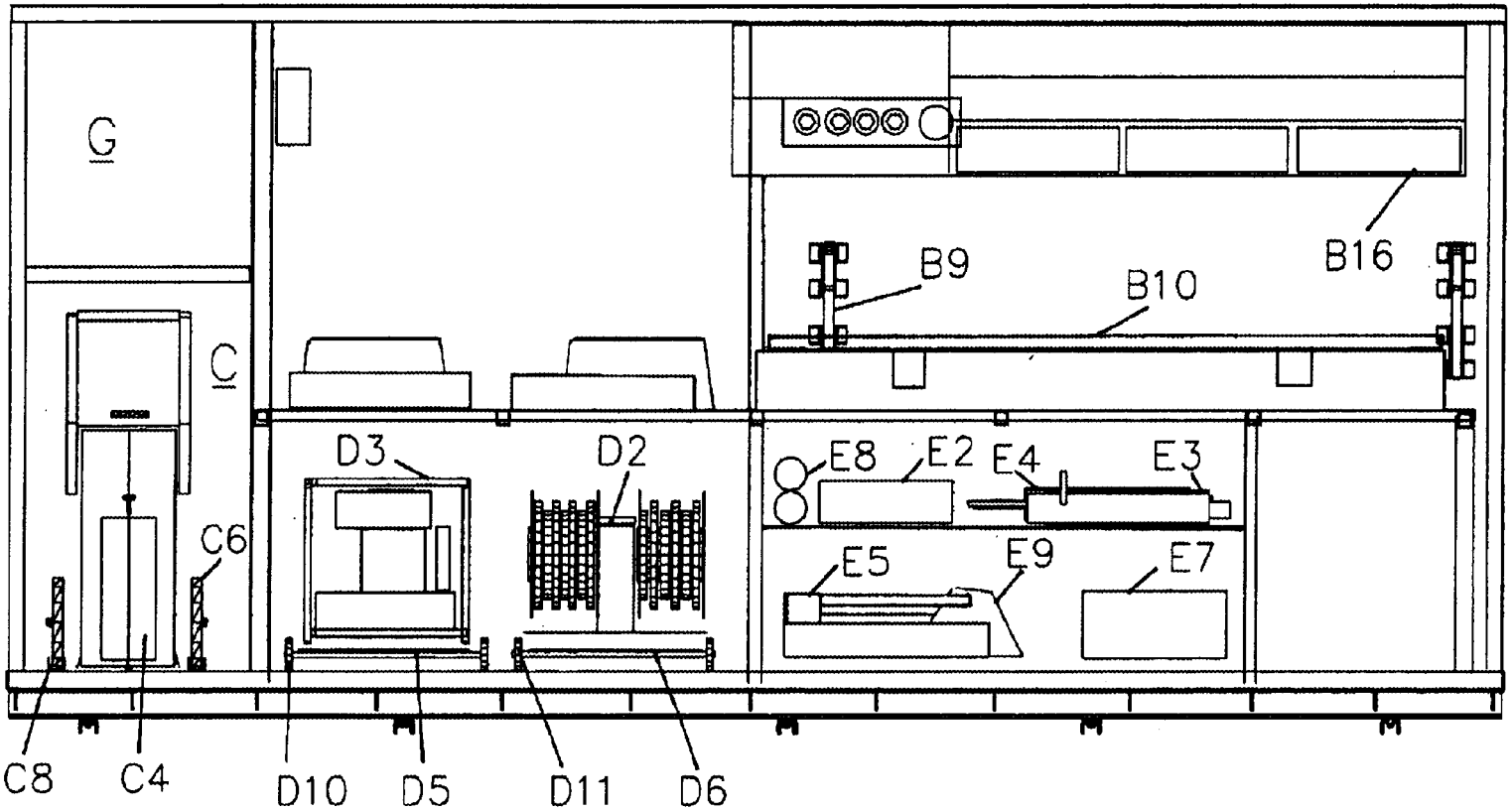
FIG. 14 presents the longitudinal cross sectional view D—D (FIG. 4) of the vehicle.
Figure 15:
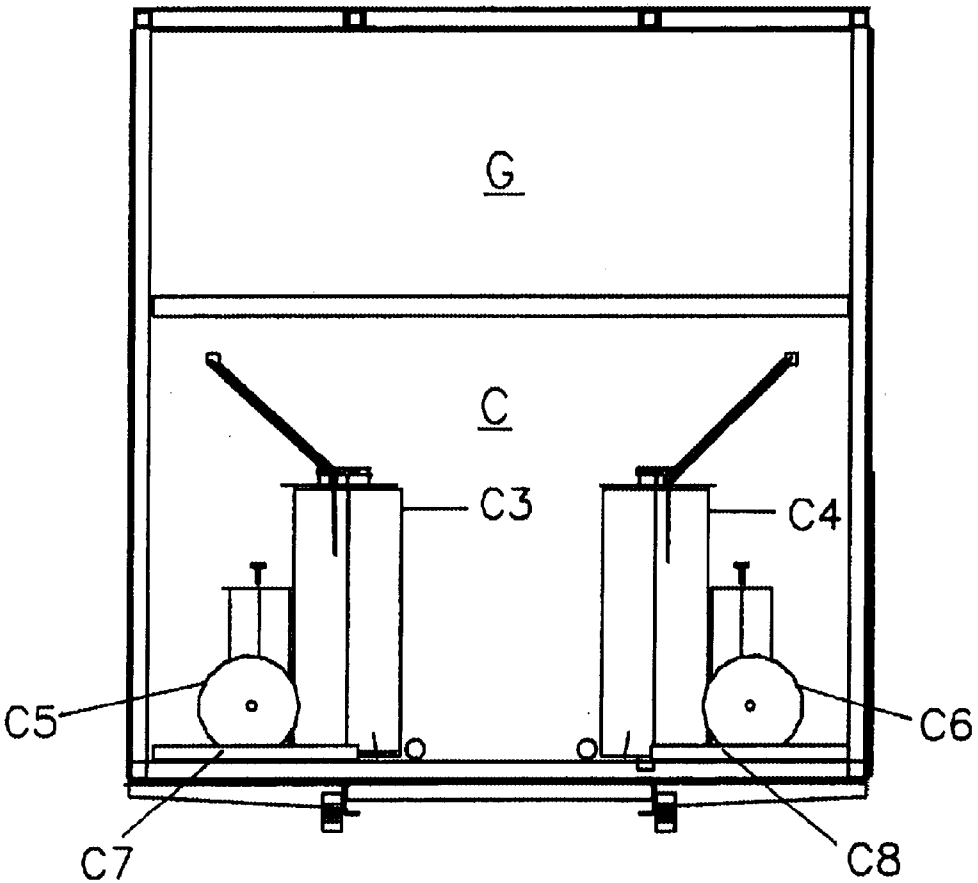
FIG. 15 presents the longitudinal cross sectional view E—E (FIG. 4) of the vehicle.
Figure 16:
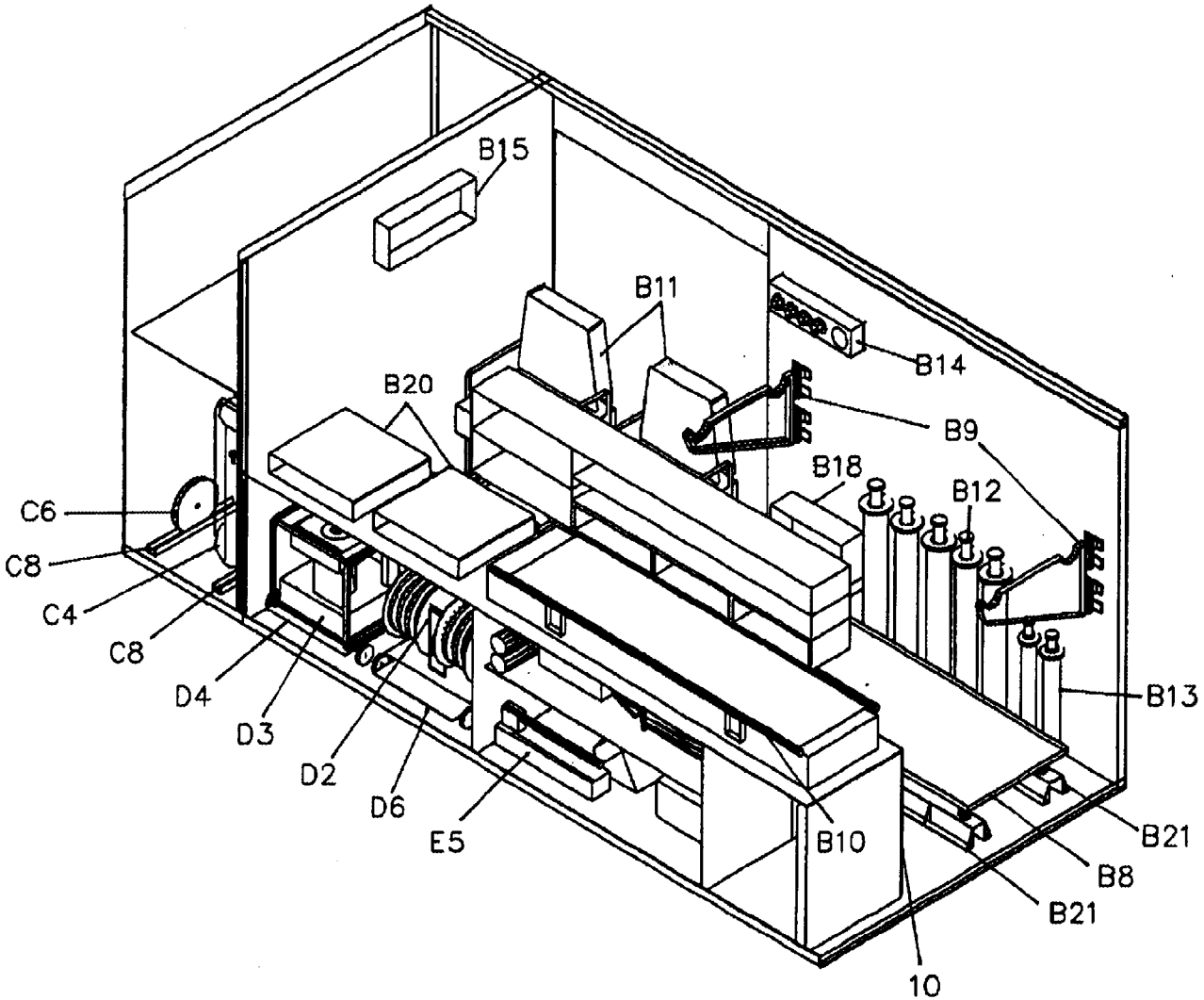
FIG. 16 presents in a perspective representation the vehicle opened along the section lines C—C and D—D.

The area of the successive compartments for the equipment for freeing and rescuing entrapped persons, D, E and the adjacent extreme rear storage area F, as represented in FIG. 10 or 12, are included in a longitudinal rectangular parallelepiped shell 10 and in the interior thereof, which is visible in FIGS. 3, 14, 16, is included the following preferably disposed arrangement of equipment:

An hydraulic pump set D3 with a suggestively four-stroke petrol engine of an illustrative power of 4,5 HP, with embodied quadric hydraulic pump, which is adapted for contemporary connection and alternative use of two salvation tools. It has two sets of outlets with adapted fast-connectors for the connection of a hydraulic cutting tool and hydraulic dilator. It is provided with a handle for the transportation thereof and is located on a wheeled stretcher D4, moving onto fixed guides D5 for its fast exit from the vehicle if this is necessary.

An arrangement of a double drum for winding the tubes D2, with tubes of different colors and a length of the order of 20 m, connected to the pump and the hydraulic tools through special fast connectors. It is provided with a transportation handle and is movably mounted onto a wheeled stretcher D6 moving on fixed guides D7 for its fast exit from the vehicle if this is necessary.

A manually-operated pump E5 for the operation of the salvation tools.

A hydraulic dilator E4 which is provided with a specially shaped handle in order to facilitate its use in the horizontal and vertical position. In the extremities of its jaws, there are provided special sockets for the mounting of traction chains.

A hydraulic scissors (cutting tool) E3 with two cutting edges and a specially shaped handgrip in order to facilitate its use in the horizontal and vertical position. Its cutting power can vary in the region of 140 to 340 KN. It permits the control of the operational velocity for carrying out operations of great accuracy.

A manually-operated cutting tool E2 for pedals, wheel, etc., with opening width of the order of 30 mm.

A telescopically extended piston E8 with operation length in the region from 460 up to 1030 mm.

A metal case E7 with the appurtenances of the salvation tools (chains, dilator), cutting scissors for the seat belts, other small tools, etc.

A portable band saw E9, petrol engine operated for the cutting of branches or trunks.

Figure 17:
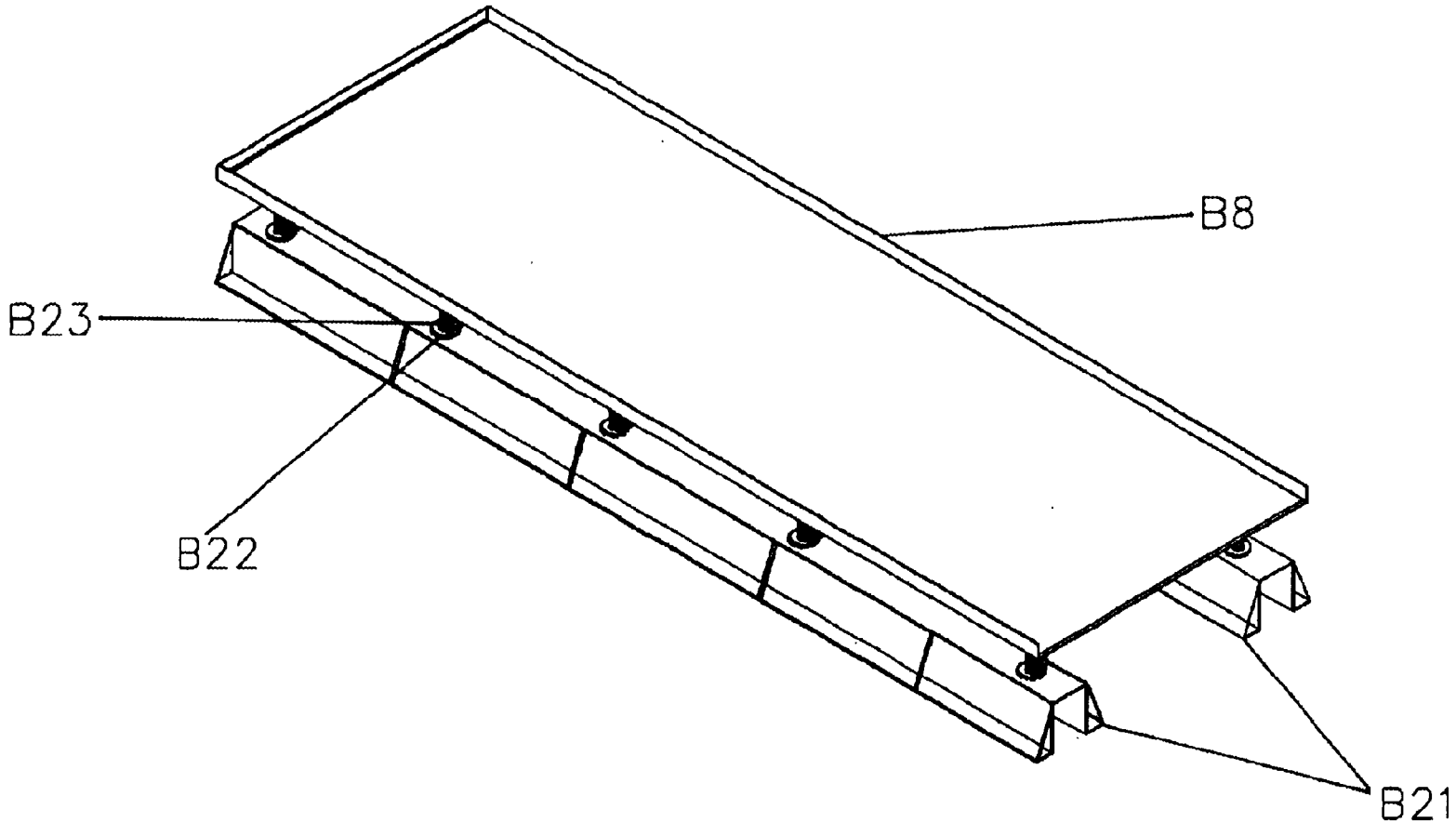
FIG. 17 presents in a perspective representation a special type of a stretcher base that is used in the vehicle.
Figure 18:
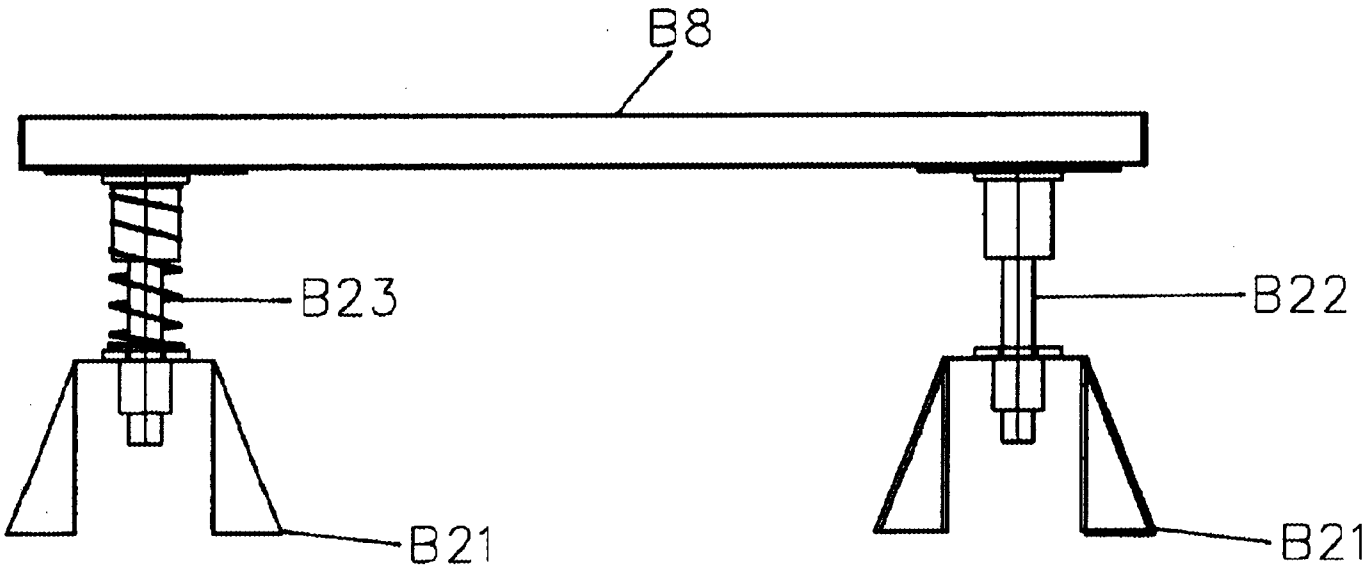
FIG. 18 presents a transverse cross sectional view of the stretcher base depicted in FIG. 17.

The area of the compartment B, for the transportation of patients—injured is the main area of the suggested vehicles and as it is represented in FIGS. 3, 5, 6, 10, 12, 13 and 16 includes the following equipment:

1. The Base B8 of a stretcher of special construction, that more specifically is represented in FIG. 17 and FIG. 18 and is constituted from two metallic longitudinally extending bases B21, which are parallel to each other and have an illustrative thickness of 1.5 mm. Bases B21 are fixedly mounted onto the hyper-construction floor, are appropriately reinforced and they have sockets to accept,—by means of longitudinally extending springs B23 which are mounted onto corresponding guide ribs B22, spaced at such distances so as to correspond with the distribution of the weight of a typical human body,—the base B8 of the stretcher and consequently the stretcher with the injured—patient. The springs are studied to ensure the absorption of the vibrations of the vehicle, due to irregularities of the road surface
2. The wheeled stretcher of commercially available type onto a foldable Roll in type base, which is located through an auxiliary guide means on top of the above-mentioned base B8.
3. The Stretcher base B9 of special make, located above the permanent stretcher base B8, as illustratively represented in FIGS. 12 and 16 in a developed position ready to use and in FIG. 19 in a closed, folded-in position. The stretcher base B9 comprises a pair of legs of circular cross section, which can rotate and be securely (FIG. 19) folded onto the right side of the interior walls of the cabin, thereby freeing the area, when there is no need to use the stretcher base B9. The bases of this stretcher are rotatable around axial pins B25, which pass through special brackets B24 mounted onto the walls of the cabin (FIG. 19), whilst maintenance of the same at the open position is implemented with a proper small pin onto the upper part of the bases. The stretcher is seated (nested) onto an elastic layer B31, thereby exhibiting the possibility of absorbing a significant part of the vibrations which are being transmitted by the vehicle. The arrangement is safely locked through the security pins B30.
4. The foldable stretcher with belt, seated onto the base B9, which is of commercially available type.
5. The foldable stretcher with belt B10 of the same commercially type, as in the above paragraph 4, seated on the substrate B17, which is anatomic, of special construction in order to absorb the vibrations and its coating is made by washable plastic. The substrate is located within a cavity so it cannot move easily and is seated on the upper surface of the rectangular parallelepiped shell 10 of the compartments area D, E, F.
6. The two armchairs for the patients of conventional market type B11 with the possibility to move along fixed guides B26 and embodied braking mechanism, with transportation handgrips.

7. The two seats for the nursing staff with indication B20.

8. Oxygen bottles, suggestively five of average capacity of the order of 15 litres B12 and two of smaller capacity of the order of 7 litres B13 fixedly mounted onto suitable base-guide, by means of belts and furthermore a panel B14 with four receivers with manometer, flow meter and humidifier.

9. Two special first aid cases B18.

10. An electric aspiration device B19.

11. Locker—drawers B16 wherein is also located an AMBU device.

12. A pair of vacuum mattresses, a special stretcher for carrying a multi injured patient, stretchers (B39&B10), blankets, etc. are all located in the compartment denoted by numeral G. When they are folded for storage, they have insignificant dimensions, whilst their overall weight does not exceed the 35 kg.

13 Electric control panel B15 with power supply switches., lighting switches, air conditioning control means and means of intercommunication between the driver and the cabin.

It is obvious that the proposed vehicle is equipped with the standard equipment for vehicles of this type, such as air conditioner, electric windlass with the proper wire ropes, hauling up ropes, operation torch lights, etc.

The loading of the motor truck selected to accept the hyper construction of the invention is calculated for each particular case with the determination of the center of gravity through application of the theorem of momentum, both in the longitudinal and transverse direction.

It has herein to be noted that the above description of the invention is made by reference to an illustrative embodiment, which is however not confining. Thus, every change or amendment as far as the shape, the dimensions, the disposition and the selection of materials and accessories is involved, provided that it does not comprise a new inventive step, is considered contained in the aims and the scope of the present invention. As presented in the claims the invention claims the exclusive privilege of manufacturing and selling of vehicles that combine at the same time, with one way or another, as far as the chosen equipment and arrangement of the same is concerned, the functions of fire fighting, freeing and rescuing entrapped people and subsequently carrying the injured or patients to the hospital, whilst such operations have up today been carried out through independent vehicles.

What is claimed is:

1. Multi functional vehicle equipped with fire fighting equipment and equipment for freeing, rescuing and transporting injured entrapped persons, characterized in that said vehicle comprises autonomous, independent compartments, each of said compartments being equipped with equipment for the implementation at the same time and in combination of the operations of fire fighting, freeing and rescuing entrapped persons and transporting injured persons and patients, wherein said independent compartments are the following:

Compartment (B) for transporting injured and patients with entrances (B1) at the rear side of the vehicle and (B2) at the right side thereof;

Compartment (C) for the fire fighting equipment with entrances (C1) at the right side and (C2) at the left side thereof, wherein said entrances are being covered by a foldable roll type screen;

Compartment (D, E) for installation of equipment for freeing and rescuing entrapped people with doors (D1), (E1) at the left side of the vehicle;

Compartment (F) for the storage of cleansing equipment with a door (F1) at the left side of the vehicle;

Compartment (G) for the storage of equipment used in the transportation of injured persons and patients, with entrances (G1) and (G2) at the, right and left side thereof respectively.

2. Multi-functional vehicle adapted to be used in the combination of operations of fire-fighting, freeing, rescuing and transporting injured entrapped persons, according to the above claim 1, wherein said compartment (B) for injured-persons and patients, includes a combination of the following:

an arrangement of stretchers being inserted through the rear door (B1) for the transportation of the injured persons and patients and more specifically of a stretcher that is seated on a base (B8), of a stretcher seated on a foldable base (B9), said base (B9) being located above said base (B8) and of a stretcher (B10) located onto a base (B17), which is located on the opposite side of the compartment, facing said stretchers with bases (B8) and (B9);

two armchairs for the patients (B11) being introduced via said side entrance (B2) movable along fixed guides (B26);

two seats for the nursing staff (B20) located adjacently to said stretcher (B10);

an arrangement of oxygen bottles, comprising five bottles of an average capacity of the order of 15 litres (B12) and two bottles of smaller average capacity of the order of 7 litres (B13) mounted onto base-guides, wherein said oxygen bottles are disposed at a position underneath said foldable stretcher base (B9) and are fixed at the walls of the compartment, said oxygen bottles being operated via a panel (B14);

two first aid cases (B18);

an electric suction pumping device (B19);

a locker—drawer (B16);

an electric control panel (B15).

3. Multi-functional vehicle adapted to be used in the combination of operations of fire-fighting, freeing, rescuing and transporting injured entrapped persons according to the above claim 2, wherein said stretcher base (B8) comprises a pair of longitudinally extending supporting bases (B21), which are parallel to each other and are fixedly mounted onto the floor of said compartment (B), said supporting bases (B21) being appropriately reinforced and having sockets to accept said stretcher base (B8) and consequently the stretcher with the injured—patient wherein a plurality of longitudinally extending springs (B23) mounted onto corresponding guide ribs (B22), provided along said longitudinally extending supporting bases (B21) and receive said stretcher base (B8) so as to ensure the absorption of the vibrations of the vehicle, due to the irregularities of the road surface.

4. Multi-functional vehicle adapted to be used in the combination of operations of fire-fighting, freeing, rescuing and transporting injured entrapped persons, according to the above claim 2, wherein said foldable stretcher base (B9) comprises a pair of legs, wherein each one of said legs is rotatable about an axial pin (B25), said axial pin (B25) extending along an arrangement of brackets (B24) fixedly mounted onto the interior wall of said compartment (B) and wherein the stretcher is seated onto an elastic layer (B31), thereby absorbing a significant part of the vibrations which are being transmitted by the vehicle and is therein safely locked through security pins (B30).

5. Multi-functional vehicle adapted to be used in the combination of operations of fire-fighting,, freeing, rescuing and transporting injured entrapped persons according to the above claim 1, wherein said compartment (C) for the fire fighting materials includes a combination of the following:

at least one fire extinguisher (C3) wheeled on wheels (C5) rolling on fixedly mounted guides (C7), said fire extinguisher (C3) containing chemical powder for the extinguishing of fires of the type A, B, C, fast secured and extracted through a right side door (C1) of the vehicle and at least one fire extinguisher (C4) wheeled on wheels (C6) rolling on fixedly mounted guides (C8), said fire extinguisher (C4) containing chemical powder for the extinguishing of fires of the type A, B, C, fast secured and extracted through a left side door (C2) of the vehicle, and an arrangement of independent launching tubes for each one of said fire extinguishers (C3,C4).

6. Multi-functional vehicle adapted to be used in the combination of operations of fire-fighting, freeing, rescuing and transporting injured entrapped persons, according to the above claim 1, wherein said compartment (D) for the installation of equipment for freeing and rescuing entrapped people includes a combination of the following:

an hydraulic pump (D3) adapted for contemporary connection and alternative use of a hydraulic cutting tool (E3) and an hydraulic dilator (E4), wherein said pump (D3) is located onto a wheeled carrier (D4) moving onto fixedly mounted guides (D5) for its fast exit from the vehicle if this is necessary;

an arrangement of a double drum for winding a pair of tubes (D2), said tubes having different colors and being connected to the pump and the hydraulic tools through special fast connectors, wherein said arrangement is movably mounted onto a wheeled carrier (D6) moving on fixedly mounted guides (D7) for its fast exit from the vehicle if this is necessary;

a manually operated pump (E5) for the operation of the salvation tools;

an hydraulic dilator (E4);

an hydraulic cutting tool (E3);

a manually operated cutting tool (E2) for pedals, wheel, etc.;

a telescopically extending piston (E8);

a portable band saw (E9) for the cutting of branches or trunks, and a metal case (E7) with auxiliary salvation feel equipment.

* * * * *